US007867010B1

(12) United States Patent
Ting et al.

(10) Patent No.: US 7,867,010 B1
(45) Date of Patent: Jan. 11, 2011

(54) ELECTRICAL CONNECTOR HAVING LATCHS FOR LOCKING WITH A COMPLEMENTARY CONNECTOR

(75) Inventors: Chien-Jen Ting, Tu-Cheng (TW); Shao-Jie Xu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/819,235

(22) Filed: Jun. 21, 2010

(30) Foreign Application Priority Data

Oct. 10, 2009 (CN) ..... 2009 2 0312163

(51) Int. Cl.
*H01R 13/627* (2006.01)

(52) U.S. Cl. ..... 439/353; 439/358

(58) Field of Classification Search ..... 439/350, 439/352, 353, 357, 358
See application file for complete search history.

(56) References Cited

U.S. PATENT DOCUMENTS 5,167,523 A * 12/1992 Crimmins et al. ..... 439/350
7,207,825 B2 * 4/2007 Le Gallic et al. ..... 439/357
7,367,834 B1 * 5/2008 Lin et al. ..... 439/345

FOREIGN PATENT DOCUMENTS

TW M317091 8/2007

* cited by examiner

*Primary Examiner*—Tho D Ta
(74) *Attorney, Agent, or Firm*—Andrew C. Cheng; Wei Te Chung; Ming Chieh Chang

(57) ABSTRACT

An electrical connector (100) includes an insulative housing (1) with an engaging portion (1*b*), a plurality of contacts (2) received in the inslulitive housing (1) with a contacting portion (22) disposed in the engaging portion (1*b*) and at least one latch (4) received in the insulative housing (1) with a locking portion (42*a*) exposed at outside of the insulative housing (1). The latch (4) has a retaining portion (41) hold in the insulative housing (1) and a locking arm (42) unitarily connecting with the retaining portion (41) obliquely.

10 Claims, 6 Drawing Sheets

ELECTRICAL CONNECTOR HAVING LATCHS FOR LOCKING WITH A COMPLEMENTARY CONNECTOR

BACKGROUND OF THE INVENTION

1. Field of the Invention

The present invention relates to an electrical connector, and more particularly, to an electrical connector having latches retained therein to locking with a complementary connector.

2. Description of the Related Art

TW Pat. No. M317091 issued to Xu on Aug. 11, 2007, discloses an electrical connector for connecting a mating connector. The electrical connector includes an insulative housing, a plurality of contacts received in the housing, a metal shell covering the insulative housing and a pair of latches retained in both sides of the insulative housing. The insulative housing has a base section and a tongue section extending forward from the base section. The contacts are arranged in the insulative housing at a transverse direction. The metal shell includes a main shell and a sub shell which are assembled with each other to provide a good shielding enclosure for the insulative housing. Each of the latches includes a retaining portion retained in the base section of the insulative housing and a spring arm extending from the retaining portion forward. The spring arm of the latch defines a locking portion at a distal free end thereof which extends outwards in through the shell for locking with the mating connector.

However, the retaining portion and the spring arm are coplanar with each other. So the retaining portion will be directly influenced by the spring arm, or even generate movement relative to the insulative housing when the spring arm is pressed by the mating connector and moving inwards in a vertical plane surface. In such a manner that the latch is unable to be securely hold in the base portion and easily remove. So the latch will be unable to lock with the mating connector steadily.

Therefore, an improved electrical connector is desired to overcome the disadvantages of the related arts.

SUMMARY OF THE INVENTION

An object of the present invention is to provide an electrical connector overcoming disadvantage of the prior art in which its latches difficulty fixed in an insulative housing and unable to lock with the mating connector steadily.

In order to achieve the above-mentioned object, an electrical connector in accordance with a preferred embodiment of the present invention includes an insulative housing with an engaging portion, a plurality of contacts received in the insulitive housing with a contacting portion disposed in the engaging portion and at least one latch received in the insulative housing with a locking portion exposed at outside of the insulative housing. The latch has a retaining portion hold in the insulative housing and a locking arm unitarily connecting with the retaining portion obliquely.

Other objects, advantages and novel features of the invention will become more apparent from the following detailed description of the present embodiment when taken in conjunction with the accompanying drawings.

DETAILED DESCRIPTION OF THE INVENTION

Figure 1:
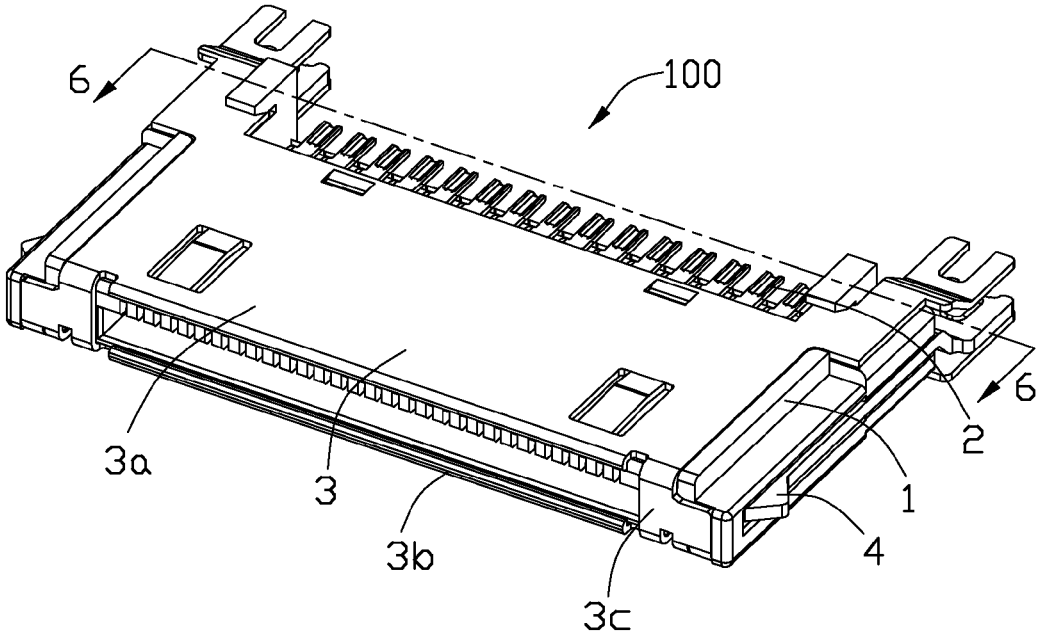
FIG. 1 is a perspective view of an electrical connector in accordance with the preferred embodiment of the present invention.

Reference will now be made to the drawing figures to describe the preferred embodiment of the present invention in detail.

Figure 2:
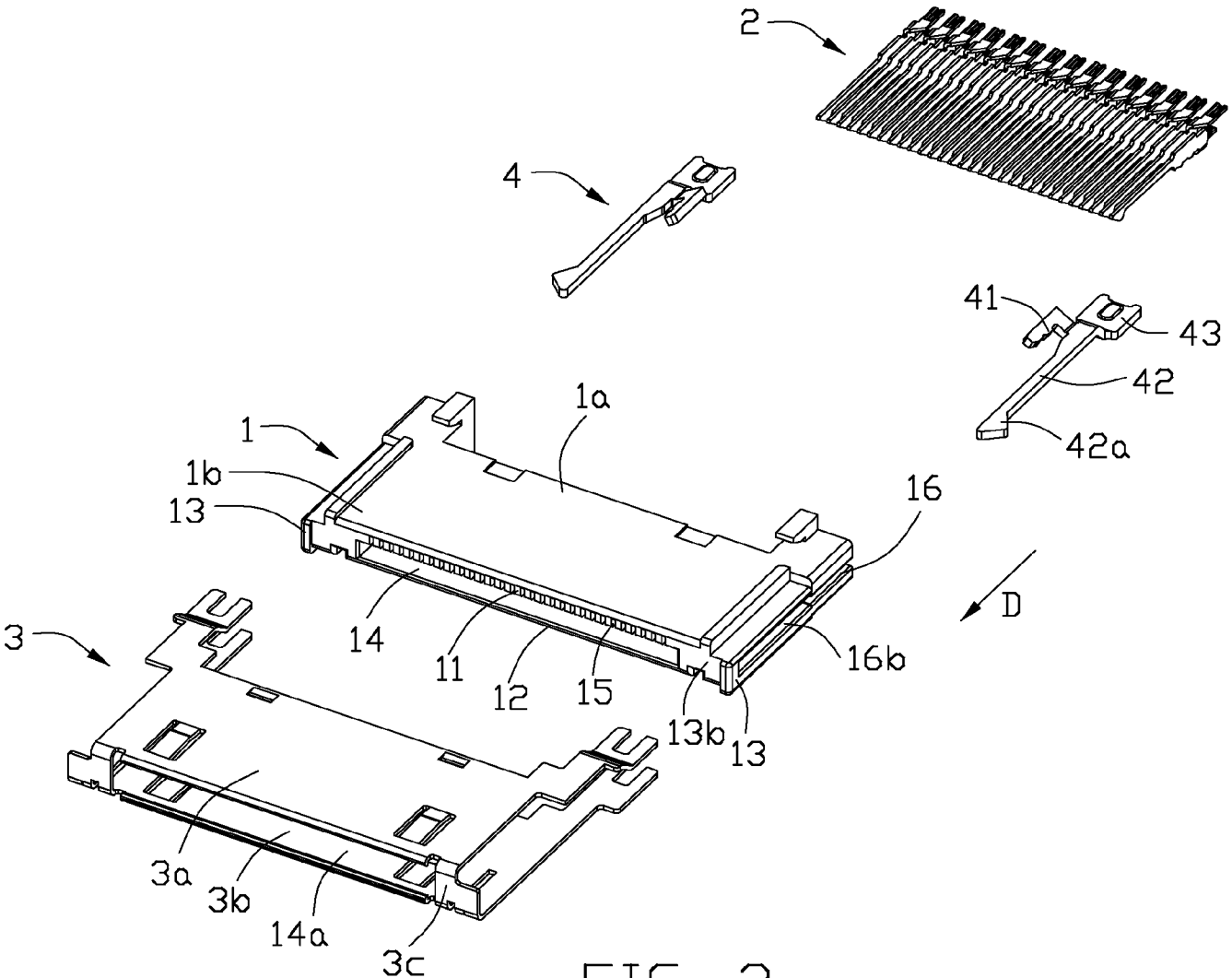
FIG. 2 is an exploded perspective view of FIG. 1.

Referring to FIGS. 1 and 2, an electrical connector 100 which can electrically interconnect with a complementary connector (not shown) is shown. Cooperation with FIG. 3, the electrical connector 100 includes an insulative housing 1 with a base portion 1*a* and an engaging portion 1*b* extending from the base portion 1*a* in a mating direction (i.e. a D direction), a plurality of contacts 2 inserted into the base portion 1*a* from a rear side 1*c* of the insulative housing 1 in the D direction, a metal shell 3 covering the insulative housing 1 and a pair of latches 4 received in both sides of the insulative housing 1.

The engaging portion 1*b* of insulative housing 1 includes an upper wall 11, a bottom wall 12 and two end walls 13 unitarily connecting with the upper wall 11 and the bottom wall 12, thereby forms a mating room 14 for receiving the complementary connector. The insulative housing 1 defines a plurality of grooves 15 extending therethrough in the D direction and in communicating with the mating room 14 for receiving the contacts 2 disposed therein respectively. Each of the contacts 2 includes a retaining portion 21 hold in the base portion 1*a*, a contacting portion 22 extending forward from a front end of the retaining portion 21 in the D direction for electrical contacting with the complementary connector and a soldering portion 23 extending rearward from a rear end of the retaining portion 21 for soldering to a connecting object (not shown).

Figure 3:
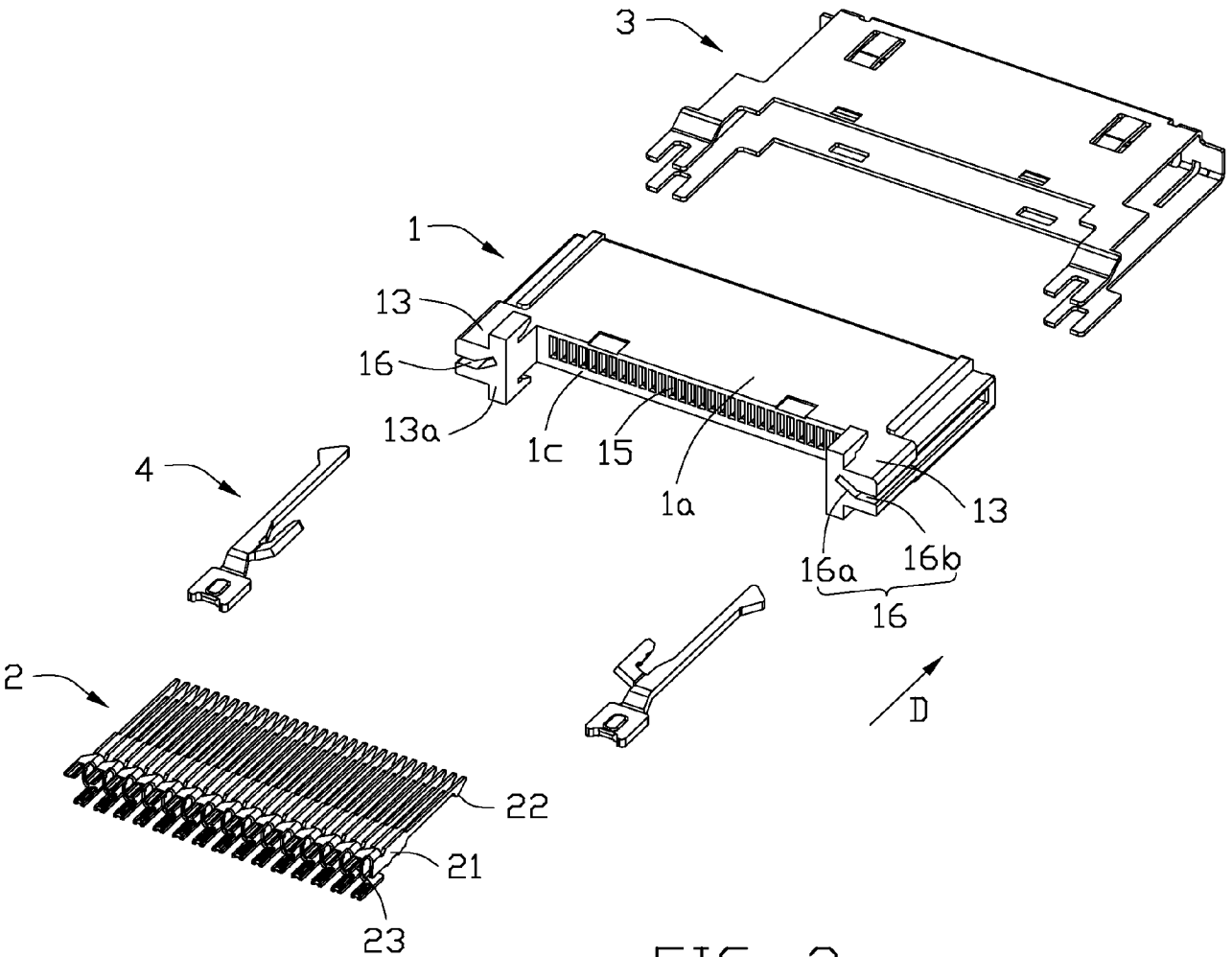
FIG. 3 is another exploded perspective view of FIG. 1 from a rear side view.
Figure 4:
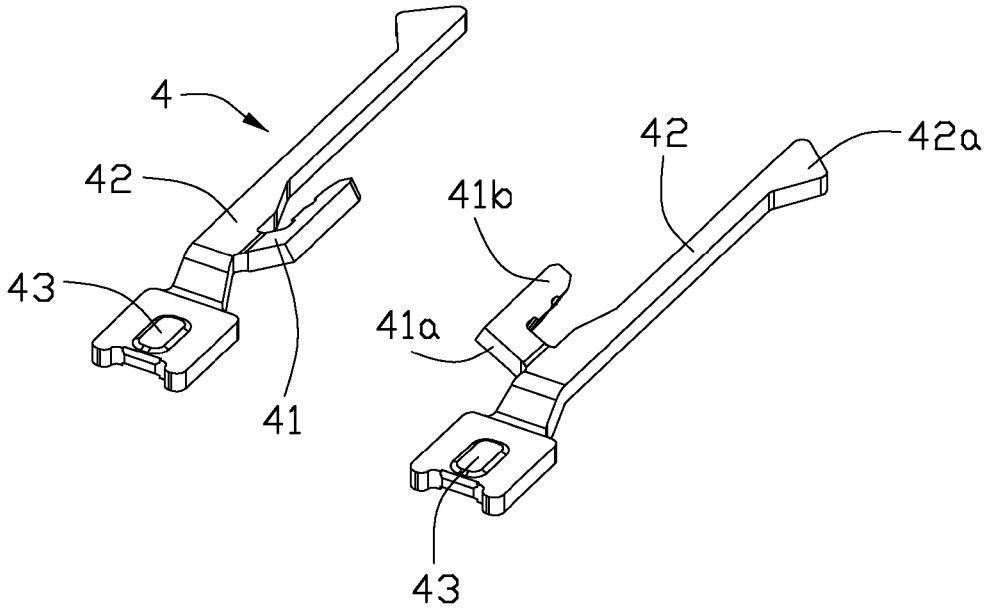
FIG. 4 is a perspective view of latches of FIG. 3.
Figure 5:
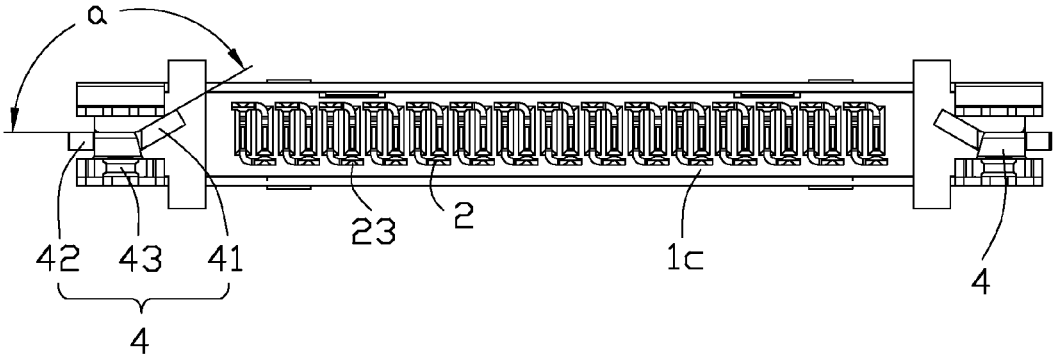
FIG. 5 is a rear elevational view of FIG. 1.
Figure 6:
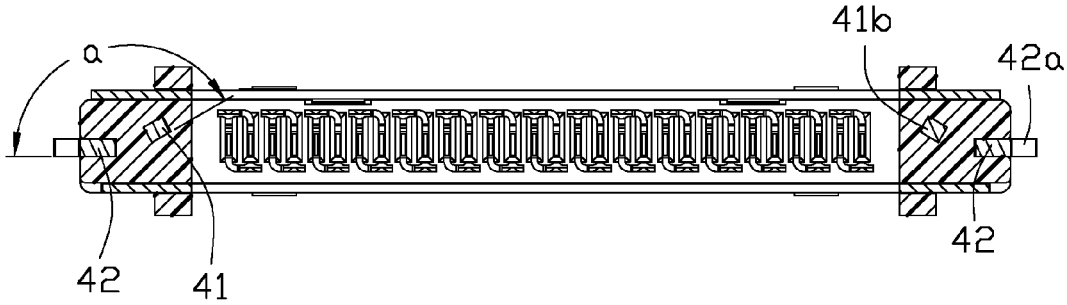
FIG. 6 is a cross-section view of the electrical connector taken along line 6-6 of FIG. 1.

Referring to FIGS. 3 to 5, the insulative housing 1 defines a receiving slot 16 running through the rear end 13*a* of the end wall 13 for receiving the latch 4 therein correspondingly. The latch 4 is formed by an integral metal plate and inserted forward into the receiving slot 16 from the rear end 13*a* in the D direction. The latch 4 includes a retaining portion 41 hold in the insulative housing 1, a locking arm 42 unitarily connecting with the retaining portion 41 obliquely and a soldering portion 43 which extends outwards from a rear end thereof and aligns with the soldering portions 23 of the contact 2 for soldering to the connecting object together. So the retaining portion 41 and the locking arm 42 form an obtuse angle $\alpha$ viewed from the rear side view (as best seen from FIGS. 4 to 6), while the locking arm 42 is parallel to a surface which the contacts 2 are disposed on.

Additional, the retaining portion 41 has a sub positioning portion 41*a* unitarily connecting with the locking arm 42 and a barb portion 41*b* at a distal free end thereof extending from the sub positioning portion 41*a* for interfering with the insulative housing 1 steadily. The barb portion 41*b* extends in the D direction in which the locking arm 42 extends also. The receiving slot 16 includes a first receiving slot 16*a* and a second receiving slot 16*b* which extends in through the first receiving slot 16*a* for respectively receiving the retaining portion 41 and the locking arm 42 therein. The locking arm 42 has an elastic configuration and defines a locking portion 42*a* at a distal free end thereof opposite to the soldering portion 43 and disposed at outside of the insulative housing 1. So the locking portion 42*a* will be pressed inward to the second receiving slot 16*b* of the receiving slot 16 by the complementary connector in process of the connectors mating with each other. Because the retaining portion 41 and the locking arm 42 form the obtuse angle α, i.e. that the locking arm 42 is not coplanar to the retaining portion 41, the retaining portion 41 is still hold in the insulative housing 1 steadily even if the locking arm 42 removes in a big range (as best seen from FIGS. 4 and 6).

Referring to FIGS. 1 and 2, the shell 3 is formed by a unitary metallic plate and includes a first wall 3*a*, a second wall 3*b* respectively attaching to the upper wall 11 and the bottom wall 12 and a connecting wall 3*c* covering a front edge 13*b* of the end wall 13, thereby forming an mating opening 14*a* in communicating with the mating room 14 for making the complementary connector the inserted therefrom.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing defining an engaging portion;

a plurality of contacts received in the insulative housing with a contacting portion disposed in the engaging portion;

at least one latch received in the insulative housing with a locking portion exposed at outside of the insulative housing;

wherein the latch comprises a retaining portion held in the insulative housing and a locking arm unitarily connecting with the retaining portion obliquely;

wherein the insulative housing comprises a receiving slot running through a rear side thereof and correspondingly receiving the retaining portion and the locking arm therein;

wherein the retaining portion comprise a sub positioning portion unitarily connecting with the locking arm and a barb portion at a distal free end thereof which extends from the sub positioning portion and interferes with the insulative housing; and wherein the receiving slot comprises a first receiving slot receiving the retaining portion and a second receiving slot which extends in through the first receiving slot and forms an obtuse angle with the first receiving slot for receiving the locking arm correspondingly.

2. The electrical connector as described in claim 1, wherein the locking arm is parallel to a surface which the contacts are disposed on and forms an obtuse angle with the retaining portion.

3. The electrical connector as described in claim 1, furthermore comprises a shell covering an upper wall and a bottom wall opposite to the upper wall of the insulative housing.

4. The electrical connector as described in claim 1, wherein the locking portion is disposed at a distal free end of the locking arm.

5. The electrical connector as described in claim 4, wherein the latch comprises a soldering portion extending outward from a rear end of the locking arm and opposite to the locking portion.

6. The electrical connector as described in claim 1, wherein the barb portion of the retaining portion extends in a mating direction in which the locking arm extends.

7. The electrical connector as described in claim 6, wherein the latch is inserted into the receiving slot in the mating direction.

8. An electrical connector comprising:

an insulative housing defining a mating port communicating with an exterior in a front-to-back direction;

a plurality of contacts disposed in the housing with front contacting sections exposed in the mating port in said front-to-back direction for mating with a complementary connector, and rear soldering sections exposed outside of the housing for mounting to a printed circuit board;

a pair of receiving slots defined in the housing by two sides of the mating port and essentially extending along said front-to-back direction;

a pair of latches respectively received in said pair of receiving slots, each of said latches including a front locking arm extending in the front-to-back direction and lying in a horizontal plane and deflectable inwardly in said horizontal plane along a transverse direction perpendicular to said front-to-back direction, a rear soldering portion exposed outside of the housing for mounting to the printed circuit board, and a retaining portion laterally extending from the locking arm and essentially being offset from said horizontal plane;

wherein said retaining portion defines a barb portion extending in said front-to-back direction, and the receiving slot defines spaced outer and inner parts to respectively receive the locking arm and the retaining portion therein after the latch is forwardly assembled to the housing from a rear side of the housing;

wherein the barb portion lies in a non-horizontal plane angled with said horizontal plane;

wherein said barb portion is obtuse relative to the horizontal plane;

wherein said receiving slot comprises a first receiving slot receiving the retaining portion and a second receiving slot which extends in through the first receiving slot and forms an obtuse angle with the first receiving slot for receiving the locking arm correspondingly.

9. The electrical connector as claimed in claim 8, wherein the whole retaining portion lies in said non-horizontal plane.

10. The electrical connector as claimed in claim 8, wherein the contacting sections of the contacts are deflected in a vertical direction perpendicular to both said front-to-back direction and said transverse direction.

* * * * *